US006889389B2

(12) United States Patent
Kleinert

(10) Patent No.: US 6,889,389 B2
(45) Date of Patent: May 10, 2005

(54) GLOVE WITH PADDING FOR BACK OF HAND

(75) Inventor: James M. Kleinert, Louisville, KY (US)

(73) Assignee: Hillerich & Bradsby, Louisville, KY (US)

( * ) Notice: Subject to any disclaimer, the term of this patent is extended or adjusted under 35 U.S.C. 154(b) by 70 days.

(21) Appl. No.: 10/330,784

(22) Filed: Dec. 27, 2002

(65) Prior Publication Data

US 2004/0123372 A1 Jul. 1, 2004

(51) Int. Cl.[7] ..... A41D 19/00
(52) U.S. Cl. ..... 2/161.1; 2/20
(58) Field of Search ..... 2/16, 20, 161.1–161.4, 2/161.6

(56) References Cited

U.S. PATENT DOCUMENTS 4,027,339 A 6/1977 Brucker
4,042,975 A * 8/1977 Elliott et al. ..... 2/19
4,067,063 A 1/1978 Ettinger
4,137,572 A 2/1979 Jansson et al.
4,438,532 A 3/1984 Campanella et al.
4,445,507 A 5/1984 Eisenberg
4,524,464 A 6/1985 Primiano et al.
4,589,146 A 5/1986 Taylor
4,663,783 A 5/1987 Obayashi
4,677,698 A 7/1987 Angas
4,700,404 A * 10/1987 Potvin ..... 2/16
4,751,749 A 6/1988 Cowhey
4,815,147 A 3/1989 Gazzano et al.
4,864,660 A 9/1989 Sawyer
4,930,162 A 6/1990 Cote
5,083,361 A 1/1992 Rudy
5,107,544 A 4/1992 Capatosto
5,136,725 A 8/1992 Montero
5,146,624 A 9/1992 Brucker
D332,845 S 1/1993 Johnston
5,218,718 A 6/1993 Chih
5,237,703 A 8/1993 Brine et al.
5,257,418 A 11/1993 Jaskiewicz
5,328,652 A 7/1994 Thomson
5,329,639 A 7/1994 Aoki
5,330,391 A 7/1994 Mitchell
5,435,008 A 7/1995 Shane
5,459,878 A 10/1995 Gold
5,488,739 A 2/1996 Cardinal
5,511,242 A 4/1996 Bianchi
5,511,243 A 4/1996 Hall et al.
5,511,244 A 4/1996 Shikatani
5,530,967 A 7/1996 Cielo
5,551,083 A 9/1996 Goldsmith
5,564,122 A 10/1996 Wagner
5,638,548 A 6/1997 Kawakami
5,640,712 A * 6/1997 Hansen et al. ..... 2/20
5,655,221 A 8/1997 Worischeck
D385,667 S 10/1997 Goldsmith
D389,283 S 1/1998 Goldsmith
5,715,539 A 2/1998 Benecki
5,717,994 A 2/1998 Goldsmith
5,720,047 A 2/1998 Spitzer
5,745,916 A 5/1998 Linner
5,781,929 A 7/1998 Shikatani
5,781,931 A 7/1998 Lee
5,787,506 A 8/1998 Wilder
5,802,614 A 9/1998 Melone, Jr.

(Continued)

*Primary Examiner*—Katherine M Moran
(74) *Attorney, Agent, or Firm*—John F. Salazar; Middleton Reutlinger

(57) ABSTRACT

A glove, includes a shock absorbing pad to overlie the back of a human hand. The shock absorbing pad is positioned to overlie the dorsal side of the hand including the metacarpals. The inner surface of the shock absorbing pad is contoured to fit the curvature of the back of the hand from the wrist area to the knuckles of the user.

44 Claims, 4 Drawing Sheets

U.S. PATENT DOCUMENTS 5,806,092 A 9/1998 Shikatani
5,809,571 A 9/1998 Spitzer
5,819,312 A 10/1998 Snyder et al.
5,884,329 A 3/1999 Goldsmith et al.
5,898,938 A * 5/1999 Baylor et al. ..... 2/20
5,946,720 A 9/1999 Sauriol
5,963,985 A 10/1999 Behr et al.
5,983,396 A 11/1999 Morrow et al.
5,996,117 A 12/1999 Goldsmith et al.
6,052,827 A 4/2000 Widdemer
6,065,150 A 5/2000 Huang
6,085,352 A 7/2000 Martin
6,105,162 A * 8/2000 Douglas et al. ..... 2/20
6,122,769 A 9/2000 Wilder et al.
6,223,744 B1 5/2001 McDuff
6,226,795 B1 * 5/2001 Winningham ..... 2/20
6,378,925 B1 4/2002 Greenlee
6,453,474 B2 * 9/2002 Kleinert ..... 2/161.1
6,701,530 B2 * 3/2004 Kleinert ..... 2/161.1

* cited by examiner

GLOVE WITH PADDING FOR BACK OF HAND

BACKGROUND OF THE INVENTION

This invention relates to gloves for the human hand and more particularly gloves for the human hand which are worn when playing sports and are subject to or exposed to contact with a moving object, such as a ball or a puck.

Glove construction for protection of the human hand is well known. Additionally, there have been a large number of developments in designs of gloves particularly useful when playing sports. Moreover, in the playing of hockey, hockey goaltender blocker gloves and forward gloves are known which are designed to protect the player's hand and arm from flying pucks. The blocker gloves are provided with a blocker pad on the back or dorsal side of the hand which are usually of rectangular shape and extend longitudinally of the glove to completely cover the back of the hand as well as the forearm. These blocker pads are designed to control the reflective direction of a hockey puck which is directed toward the goal wherein the goaltender prevents the puck from entering the goal. These blocker gloves generally have a thick leather skin on the face and thereunder a plurality of layers of padding material. However, there has generally been very little concern for the development of padding which adequately protects the back of the hand and is contoured to fit over the shape of the hand thereby providing for a comfortable fit as well as protection of the dorsal side of the hand.

SUMMARY OF THE INVENTION

It is an object of the present invention to provide a protective glove to protect the dorsal side of the human hand from the wrist area to the knuckles area.

It is another object of the present invention to provide a protective glove to protect the dorsal side of the human hand for play in athletic competition, such as a hockey forward player or a hockey goaltender player.

More particularly, the present invention is directed to a glove which includes a glove shell having a dorsal side segment and a palmar side segment and at least one finger section segment extending outwardly from the dorsal side and the palmar side. The shell is also provided with an opening therein opposite said finger section to receive a human hand therein. A first shock absorbing pad is positioned to cover the dorsal side of the hand generally from the wrist area to the knuckle area and particularly to overlie the metacarpals of each of the fingers and the respective metacarpalphalangeal joints. The dorsal side segment of the glove generally includes an inner panel and an outer panel to receive the first shock absorbing pad therein. The first shock absorbing pad includes an inner surface adjacent said inner panel and an outer surface adjacent said outer panel. The inner surface of the first shock absorbing pad is provided with a first radius of curvature at a wrist end of the inner surface and a second radius of curvature at the knuckle end of the inner surface wherein the second radius of curvature is generally greater than the first radius of curvature. Preferably, the first shock absorbing pad is narrower at the wrist end of the pad than at the knuckle end of the pad. And, the first shock absorbing pad is longer along an index finger portion of the hand from the wrist end to the knuckle end, than the length adjacent the small finger portion of the hand from the wrist end to the knuckle end.

In other embodiments, the pad may include a second shock absorbing pad disposed to overlie the first shock absorbing pad wherein the second shock absorbing pad is of a padding which is more firm than that of the first shock absorbing pad.

Further objects and advantages of this invention will appear from the following description and appended claims, reference being made to the accompanying drawings forming a part of the specification wherein like references designate corresponding parts into several views.

DETAILED DESCRIPTION OF THE PREFERRED EMBODIMENTS

Figure 1:
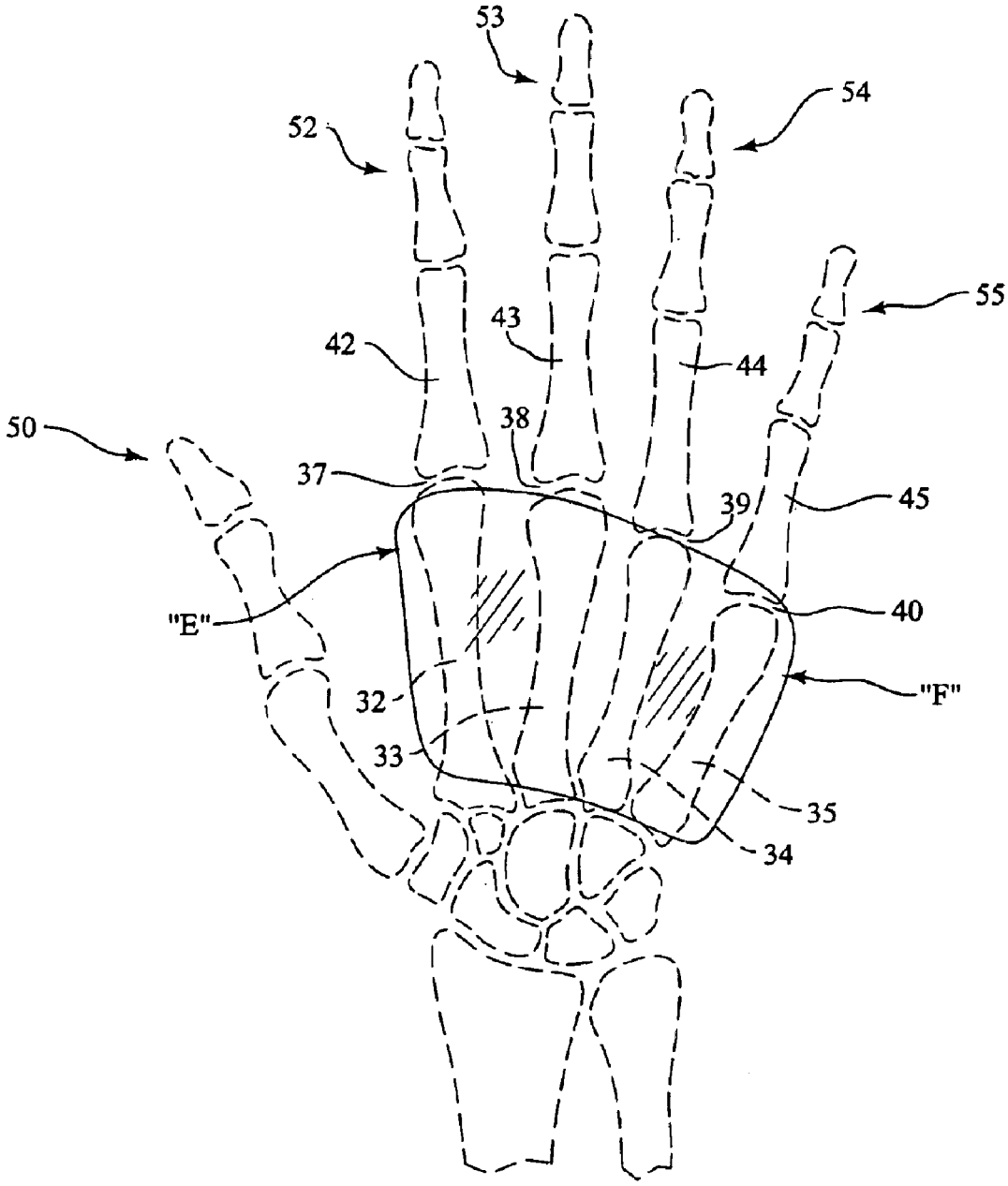
FIG. 1 is a schematic anatomical view of the bones of a right human hand showing the dorsal side details and a first shock absorbing pad of the present invention.

As shown in FIG. 1 is a skeletal outline of a right human hand showing the location of a shock absorbing pad 18 over the back of the hand adjacent to the wrist area and the knuckles of the hand. Specifically, pad 18 covers the metacarpals 32, 33, 34 and 35 of the index finger, long finger, ring finger and small finger, respectively. Moreover, the padding 18 extends over the proximal portion of the metacarpalphalangeal joints 37, 38, 39 and 40, respectively. Also, as shown in FIG. 1, the inner length of the pad 18, as designated by the letter "E" which is between the index finger 52 and the thumb 50, is greater than the outer length, designated by the letter "F" which extends along the small finger 58. Particularly, the length of the side designated by the letter "E" for an adult hand will be from about 2.0" to about 4.0" and the length of the side designated by the letter "F" will be from about 1.4" to about 2.85". The ratio of the length "E" to "F" will be in a range of 1.1 to 1.75 and preferably approximately 1.43.

As shown in FIG. 1, the shock absorbing padding 18 in a preferred embodiment, as discussed hereinafter, in combination with another shock absorbing pad identified by the number 16 (FIG. 2), to be discussed hereinafter, illustrates a preferred embodiment of the present invention.

Figure 3:
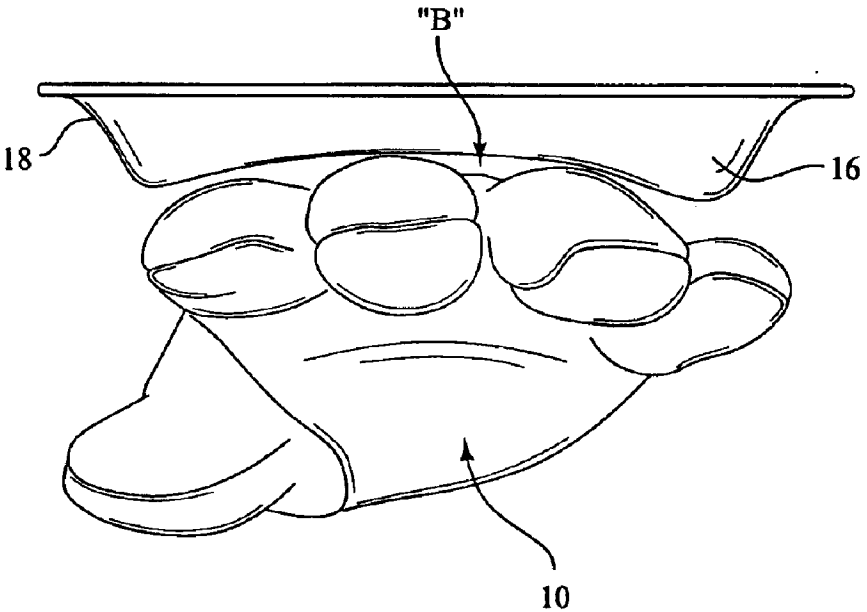
FIG. 3 is an end view of FIG. 2 shown from the fingers end of the glove.
Figure 2:
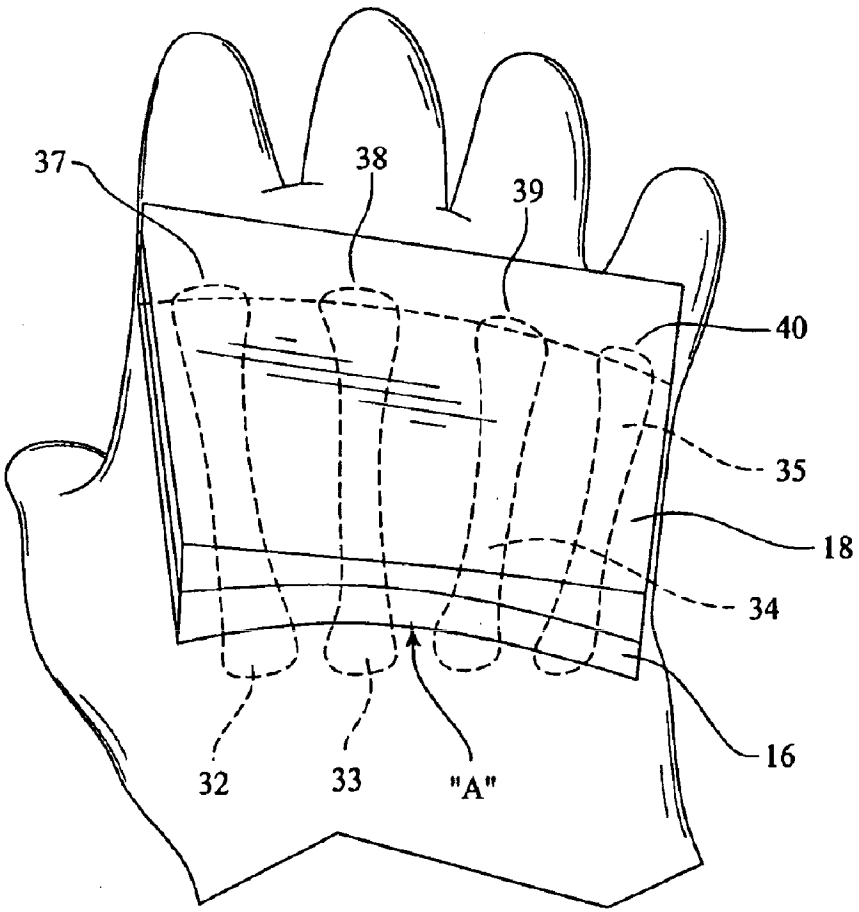
FIG. 2 is a perspective view of one preferred glove of the present invention showing an overlie of the padding on the back side of a hand.

Referring now to FIGS. 2 and 3, a shell 10 for a glove is shown in outline around the shock absorbing pad 16 which is the inner or first shock absorbing pad overlying the back of the hand, and particularly, the metacarpals 32, 33, 34 and 35, the proximal portion of the metacarpalphalangeal joints 37, 38, 39 and 40. And, the shock absorbing pad 18 is positioned to overlie the first shock absorbing pad 16. Preferably, the first shock absorbing pad 16 is a soft rubber or foamed elastomeric material and the top or second shock absorbing pad 18 is of a firmer or harder elastomeric material and may include a slow release elastomeric material. Particularly, as shown in FIG. 2, the curvature of the first shock absorbing pad 16 conforms to the back of the hand adjacent to the wrist area with a radius of curvature adjacent the wrist area identified by the letter "A".

The radius of curvature "A" will be from about 2.0" to about 4.5" for both adult male and female gloves and will have a linear length of from about 2.1" to about 3.1". Specifically, for a glove for a female adult, the linear length of "A" will be from 2.1" to about 2.7" and for a male adult will be about 2.5" to 3.1".

As best shown in FIG. 3, the inner surface of the first shock absorbing pad 16, which overlies the back of the hand, has a radius of curvature of from about 3.0" to about 6.8" for both female and male adults. The linear length of "B" will usually be from about 2.8" to about 3.4" for an adult female and from about 3.2" to about 4.0" for an adult male.

More particularly, the ratio of the radius of curvature of the padding adjacent the wrist area and identified by the letter "A" to the radius of curvature of the inner surface of the first shock absorbing pad 16, adjacent the knuckle area of the hand, identified by the letter "B" will be in a range of 0.50 to 0.85 and preferably will be approximately 0.69. Also, the ratio of the linear length of the inner surface of the first shock absorbing pad adjacent the wrist area and identified by the letter "A" to the linear length of the inner surface of the first shock absorbing pad 16 adjacent to the knuckle area and identified by the letter "B" will be in a range of 0.60 to 0.90 and preferably approximately 0.77.

Figure 4:
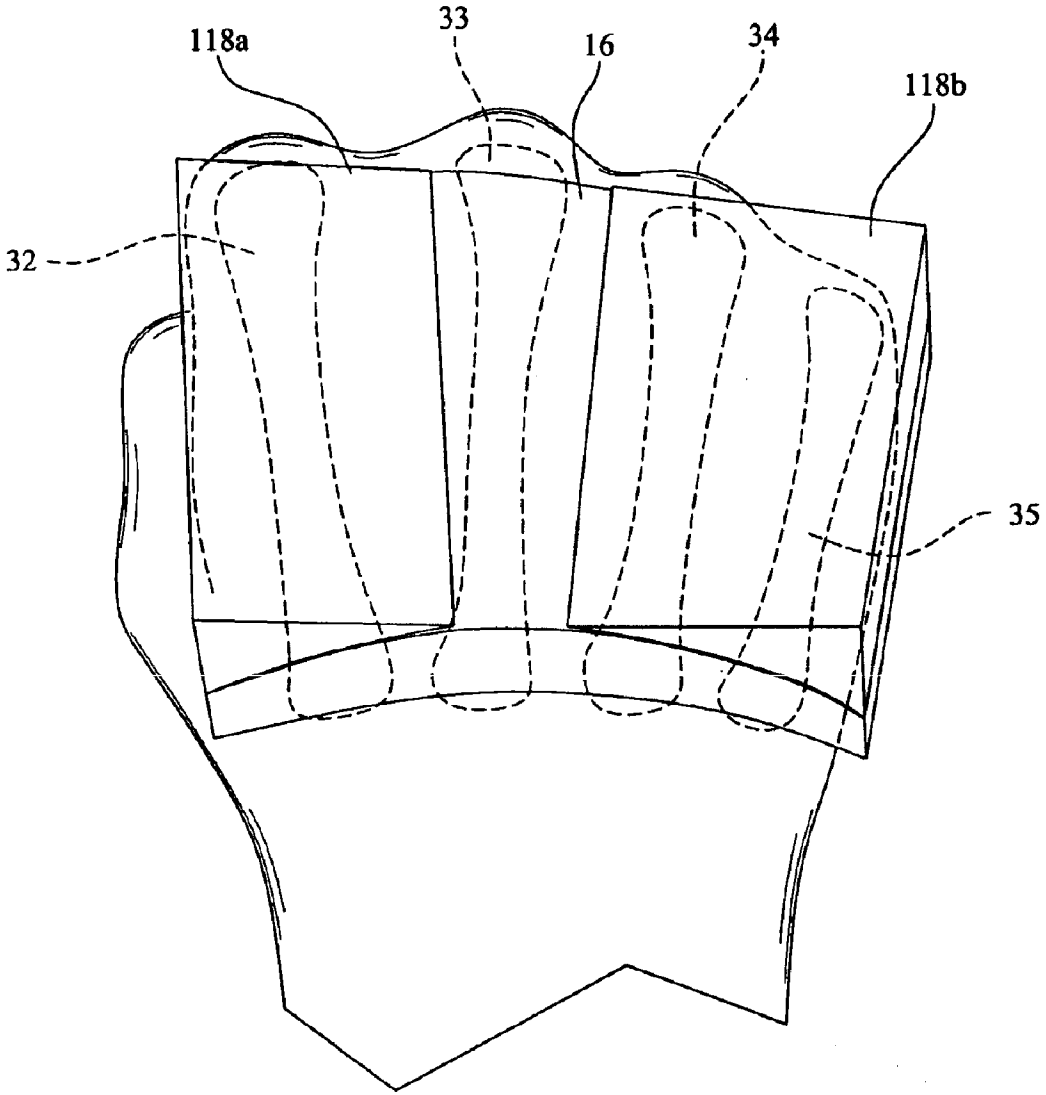
FIG. 4 is a perspective view of a second preferred embodiment of the present invention; and, FIG. 5 is a perspective view of a glove of the present invention attached to a blocker shield for a hockey goaltender's glove.

Referring now to FIG. 4 is another embodiment of the present invention wherein the top shock absorbing pad is in two sections identified as 118*a* and 118*b*. As shown in the figures, the two second shock absorbing pads 118*a* and 118*b* are of generally wedge-shaped or arcuate-shaped construction with a gap disposed between the inner surface of the two pads 118*a* and 118*b* and the outer surface of the first shock absorbing pad 16. The gap is generally greatest adjacent the midpoint of the first shock absorbing pad 16 and the terminating inner side surfaces of the pads 118*a* and 118*b*. It is realized that in a modification of this embodiment, the glove may be absent of the first shock absorbing pad 16 and the two wedge pads 118*a* and 118*b* would be contoured along their lower surfaces to fit the dorsal side of the hand with a gap between the dorsal side of the shell 10 and an inner surface of the pads 118*a*, 118*b*. It is further realized that only one pad 118*a* and 118*b* may be used.

Figure 5:
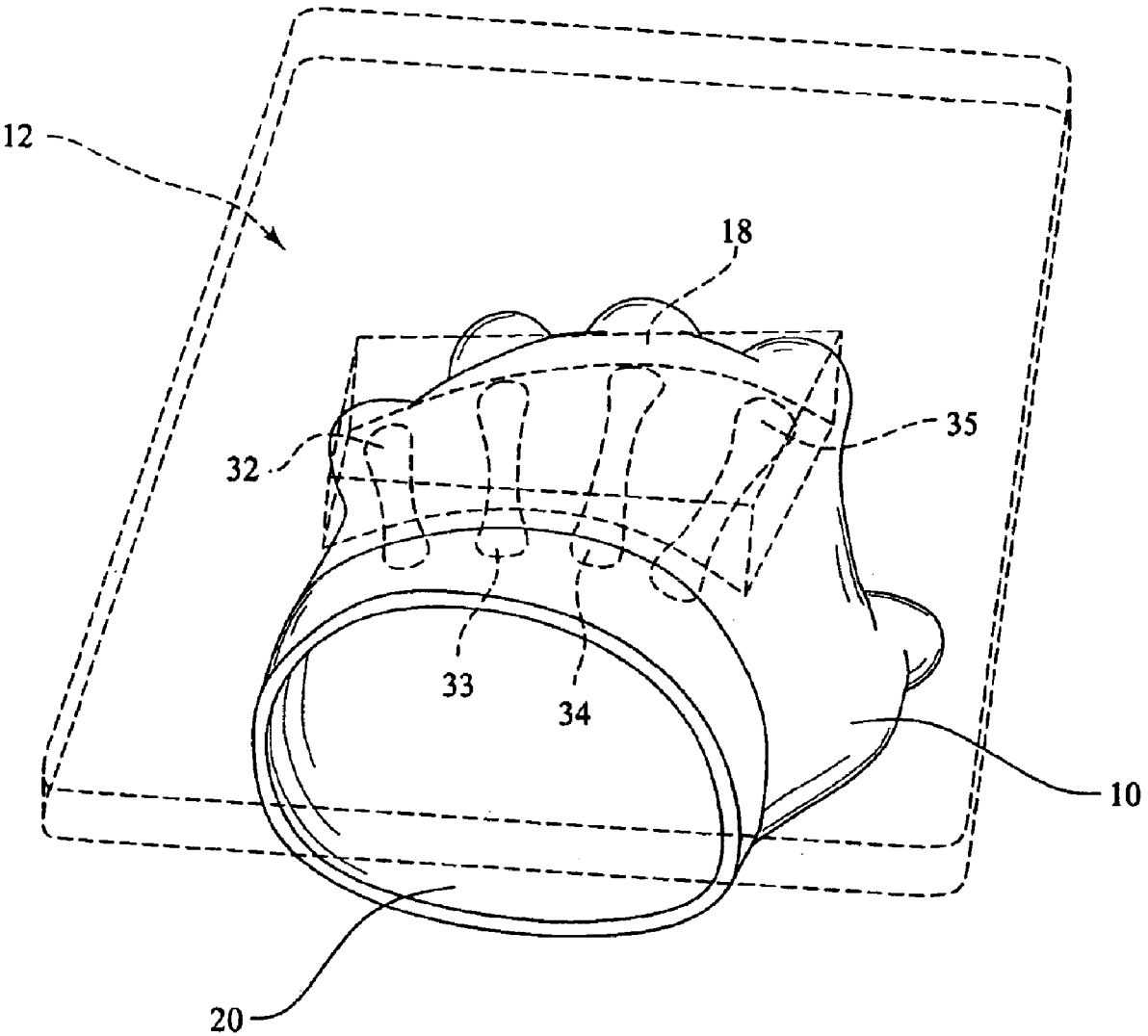

As shown in FIG. 5, a glove shell 10 having an opening 20 therein to receive a hand, is attached to, for example, a blocker shield 12 for use in a hockey goaltender blocker glove. It is also realized that the glove shell 10 is appropriate for use for other hockey gloves, such as a forward glove which is subjected to impact by flying pucks as well as other types of ball gloves and mitts wherein the human hand is subjected to contact by flying objects or other forms of contact to which the back of a human hand may be subjected.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A glove comprising:

a glove shell having a dorsal side segment, a palmar side segment, and at least one finger section segment extending outwardly from said dorsal side and said palmar side, said shell having an opening therein opposite said finger section segment;

a first shock absorbing pad positioned along the dorsal side of said shell disposed to overlie at least one metacarpal and a proximal portion of the metacarpal-phalangeal joint, said first shock absorbing pad having a wrist end and a knuckle end, said first shock absorbing pad having an inner concave surface adjacent a dorsal side of a human hand, said inner surface at said wrist end having a first radius of curvature, said inner surface at said knuckle end having a second radius of curvature, said second radius of curvature being greater than said first radius of curvature.

2. The glove of claim 1 including a second shock absorbing pad disposed to overlie said first shock absorbing pad, said first shock absorbing pad being softer than said second shock absorbing pad.

3. The glove of claim 1, said first radius of curvature being from about 0.50 to 0.85 of said second radius of curvature.

4. The glove of claim 3, said first radius of curvature being approximately 0.69 of said second radius of curvature.

5. The glove of claim 1, said first radius of curvature being from about 2.0" to about 4.5".

6. The glove of claim 1, said second radius of curvature being from about 3.0" to about 6.8".

7. The glove of claim 1, said first shock absorbing pad having a wrist end and a knuckle end, said first shock absorbing pad being narrower at said wrist end than said knuckle end.

8. The glove of claim 7, said wrist end having a width of from about 0.60 to about 0.90 of the width of said knuckle end.

9. The glove of claim 8, said width of said wrist end being approximately 0.77 of said width of said knuckle end.

10. The glove of claim 1, said first shock absorbing pad having an inner length positioned between a thumb and an index finger of said glove and an outer length positioned along a small finger section of said glove from a wrist end to a knuckle end, said inner length being greater than said outer length.

11. The glove of claim 10, said inner length being greater than said outer length by a factor of from 1.10 to about 1.75.

12. The glove of claim 11, said inner length being approximately 1.43 times greater than the outer length.

13. The glove of claim 1, said at least one finger section including an index finger section, a long finger section a ring finger section and a small finger section.

14. The glove of claim 1, said at least one metacarpal includes the metacarpals of an index finger a long finger, a ring finger, or a small finger or combinations thereof.

15. The glove of claim 1 including a second shock absorbing pad disposed to overlie said first shock absorbing pad.

16. The glove of claim 15, said second shock absorbing pad being in two sections of generally arcuate shape with a gap disposed therebetween.

17. The glove of claim 16, said gap being greatest adjacent a mid point of the width of said first shock absorbing pad.

18. The glove of claim 15, said second shock absorbing pad being in two sections on opposed sides of said hand defining a gap between said first shock absorbing pad and said second shock absorbing pad.

19. The glove of claim 18, each of said second shock absorbing pads being wedge-shaped.

20. The glove of claim 1, said first shock absorbing pad being in two sections of generally arcuate shape with a gap disposed therebetween.

21. The glove of claim 20, said gap being greatest adjacent a mid point of the width of said first shock absorbing pad.

22. The glove of claim 20, said first shock absorbing pad being in two sections on opposed sides of said hand defining a gap between said first shock absorbing pad and said dorsal side of said shell.

23. The glove of claim 22, each of said first shock absorbing pads being wedge-shaped.

24. The glove of claim 1 including a blocker shield attached along a top surface of said glove.

25. A glove comprising:

a glove shell having a dorsal side segment, a palmar side segment, and at least one finger section segment extending outwardly from said dorsal side and said palmar side, said shell having an opening therein opposite said finger section segment;

a first shock absorbing pad positioned along the dorsal side of said shell disposed to overlie the back of a hand from a wrist area to a knuckles area at a location adjacent a proximal portion of the metacarpalphalangeal joints, said first shock absorbing pad having a wrist end and a knuckle end, said first shock absorbing pad having an inner concave surface positioned to be adjacent a dorsal side of a human hand, said inner surface at said wrist end having a first radius of curvature, said inner surface at said knuckle end having a second radius of curvature, said second radius of curvature being greater than said first radius of curvature.

26. The glove of claim 25, including a second shock absorbing pad disposed to overlie said first shock absorbing pad, said first shock absorbing pad being softer than said second shock absorbing pad.

27. The glove of claim 26, said first radius of curvature being approximately 0.69 of said second radius of curvature.

28. The glove of claim 25, said first radius of curvature being from about 0.50 to 0.85 of said second radius of curvature.

29. The glove of claim 28, said first radius of curvature being from about 2.0" to about 4.5".

30. The glove of claim 28, said second radius of curvature being from about 3.0" to about 6.8".

31. The glove of claim 25, said first shock absorbing pad being narrower at said wrist end than said knuckle end.

32. The glove of claim 31, said wrist end having a width of from about 0.60 to about 0.90 of the width of said knuckle end.

33. The glove of claim 32, said width of said wrist end being approximately 0.77 of said width of said knuckle end.

34. The glove of claim 25, said first shock absorbing pad having an inner length positioned between a thumb and an index finger of said glove and an outer length positioned along a small finger section of said glove from a wrist end to a knuckle end, said inner length being greater than said outer length.

35. The glove of claim 34, said inner length being greater than said outer length by a factor of from 1.10 to about 1.75.

36. The glove of claim 25, said inner length being approximately 1.43 times greater than the outer length.

37. The glove of claim 25, said at least one finger section including an index finger section, a long finger section, a ring finger section and a small finger section.

38. The glove of claim 25, said at least one metacarpal includes the metacarpals of an index finger, a long finger, a ring finger, or a small finger or combinations thereof.

39. The glove of claim 25, including a second shock absorbing pad disposed to overlie said first shock absorbing pad.

40. The glove of claim 39, said second shock absorbing pad being in two sections of generally arcuate shape with a gap disposed therebetween.

41. The glove of claim 40, said gap being greatest adjacent a mid point of the width of said first shock absorbing pad.

42. The glove of claim 39, said second shock absorbing pad being in two sections on opposed sides of said hand defining a gap between said first shock absorbing pad and said second shock absorbing pad.

43. The glove of claim 42, each of said second shock absorbing pads being wedge-shaped.

44. The glove of claim 25, includng a blocker shield attached along a top surface of said glove.

* * * * *